US006823823B2

(12) United States Patent
Kim

(10) Patent No.: US 6,823,823 B2
(45) Date of Patent: Nov. 30, 2004

(54) WATER JACKET STRUCTURE FOR CYLINDER BLOCK AND CYLINDER HEAD OF AN ENGINE WITH A SPLIT COOLING SYSTEM ADAPTED THEREIN

(75) Inventor: Kyoung-Hee Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/443,897

(22) Filed: May 21, 2003

(65) Prior Publication Data

US 2004/0079300 A1 Apr. 29, 2004

(30) Foreign Application Priority Data

Oct. 24, 2002 (KR) ..... 10-2002-0065219

(51) Int. Cl.[7] ..... F02B 75/18
(52) U.S. Cl. ..... 123/41.74; 123/41.82 R
(58) Field of Search ..... 123/41.1, 41.28, 123/41.29, 41.74, 41.79, 41.82 R

(56) References Cited

U.S. PATENT DOCUMENTS 4,109,617 A 8/1978 Ernest
4,683,844 A 8/1987 Arai et al.
5,497,734 A * 3/1996 Okada ..... 123/41.1
5,970,926 A 10/1999 Tsunoda et al.

FOREIGN PATENT DOCUMENTS

| | | |
|---|---|---|
| EP | 0 450 067 B1 | 8/1989 |
| EP | 0 856 650 B1 | 2/1998 |
| WO | WO 96/03574 | 7/1994 |
| WO | WO 98/54455 | 5/1998 |

* cited by examiner

*Primary Examiner*—Noah P. Kamen
(74) *Attorney, Agent, or Firm*—Morgan Lewis & Bockius LLP

(57) ABSTRACT

A water jacket structure for a cylinder head and cylinder block of an automobile engine with a split cooling system adapted therein is disclosed, in which the shape of the inlet of the water jacket is altered to diminish the flow loss, and the position of the outlets for the cylinder head and the cylinder block is disposed at the same height to improve the life expectancy of the thermostat device. Water jackets are formed for the cylinder head and the cylinder block respectively and independently. An inlet is shared between the cylinder head and the cylinder block, with its cross sectional area being reduced inward, and two outlets are formed on the cylinder head respectively and independently.

11 Claims, 6 Drawing Sheets

WATER JACKET STRUCTURE FOR CYLINDER BLOCK AND CYLINDER HEAD OF AN ENGINE WITH A SPLIT COOLING SYSTEM ADAPTED THEREIN

FIELD OF THE INVENTION

The present invention relates to a water jacket structure for the cylinder head and cylinder block of an engine and, more particularly, to a water jacket structure with a split cooling system adapted therein to reduce the flow loss of the cooling water and improve the life expectancy of the installed thermostat device.

BACKGROUND OF THE INVENTION

Generally, the cooling system of an automobile engine maintains the engine at normal operating temperatures and protects engine components such as a cylinder block, cylinder head and pistons from thermal harm. The temperature of the combustion chamber of the engine can reach up to around 2500° C.

A split cooling system has been proposed in which separate flow passages of the cooling water are provided for the cylinder head and the cylinder block respectively. That is, a water jacket for the cylinder head and another water jacket for the cylinder block are separated from each other, and an inlet through which the cooling water path is connected from an outlet of a water pump to the water jackets is shared at the frontal side of the engine. Further, the water jackets are independently connected to two outlets, the outlets being respectively formed at rear sides of the cylinder head and the cylinder block, i.e., at the rear side of the engine.

The opening degree of the thermostat device is adjusted in accordance with the temperature of the cooling water to control the flow of the cooling water that communicates with the two outlets of the cylinder head and the cylinder block. Accordingly, the cooling water flows from the water pump through the inlet and split into the water jacket of the cylinder head and the water jacket of the cylinder block. Then the cooling water flows through the interior of the water jackets to be sent through the two outlets into the thermostat device.

However, in the conventional water jackets, the inlet generally has a rectangular cross section, and therefore, a vortex can be formed in the inlet IN to cause pressure loss and flow loss. Further, two outlets are provided for both water jackets, and therefore, the thermostat device which communicates with the water jackets is positioned between the cylinder head and the cylinder block.

Accordingly, the relative behaviors of the cylinder head and the cylinder block lead to a generation of vibration, and therefore, repeated loads are imposed on the thermostat device, thereby aggravating the life expectancy of the thermostat device.

SUMMARY OF THE INVENTION

The present invention provides a water jacket structure for a cylinder head and cylinder block of an automobile engine with a split cooling system adapted therein, in which the shape of the inlet of the water jacket is altered to diminish the flow loss, and the position of the outlet for the water jacket of the cylinder block is raised to the same or similar level of the outlet for the water jacket of the cylinder head to extend the life expectancy of the thermostat device.

In accordance with one embodiment of the present invention, the water jacket structure for the cylinder head and cylinder block of an automobile engine with a split cooling system adapted includes water jackets formed at the cylinder head and cylinder block respectively and independently. An inlet is shared between the cylinder head and cylinder block, with its cross sectional area being reduced coming inward. The positions of the two outlets have the same or similar level at the cylinder head.

In an alternative embodiment of the invention, a cooling structure for a cylinder head and a cylinder block of an engine includes first and second water jackets. The first water jacket is formed on the cylinder head and defines a first inlet of a first width. The second water jacket is formed around the cylinder block and defines a second inlet of a second width. Preferably, the first and second widths are substantially the same. A common inlet passage communicates with the first and second inlets. The inlet passage has a width greater than the first and second widths. In a further preferred embodiment, the inlet passage is trapezoidal in shape with the smaller side defining the inlets. The structure may also include first and second outlets, respectively, communicating with the first and second water jackets. The outlets are preferably separately formed on the cylinder head. The second outlet may include a vertical passage configured and dimensioned such that the first and second outlets open at substantially the same level with respect to the engine.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
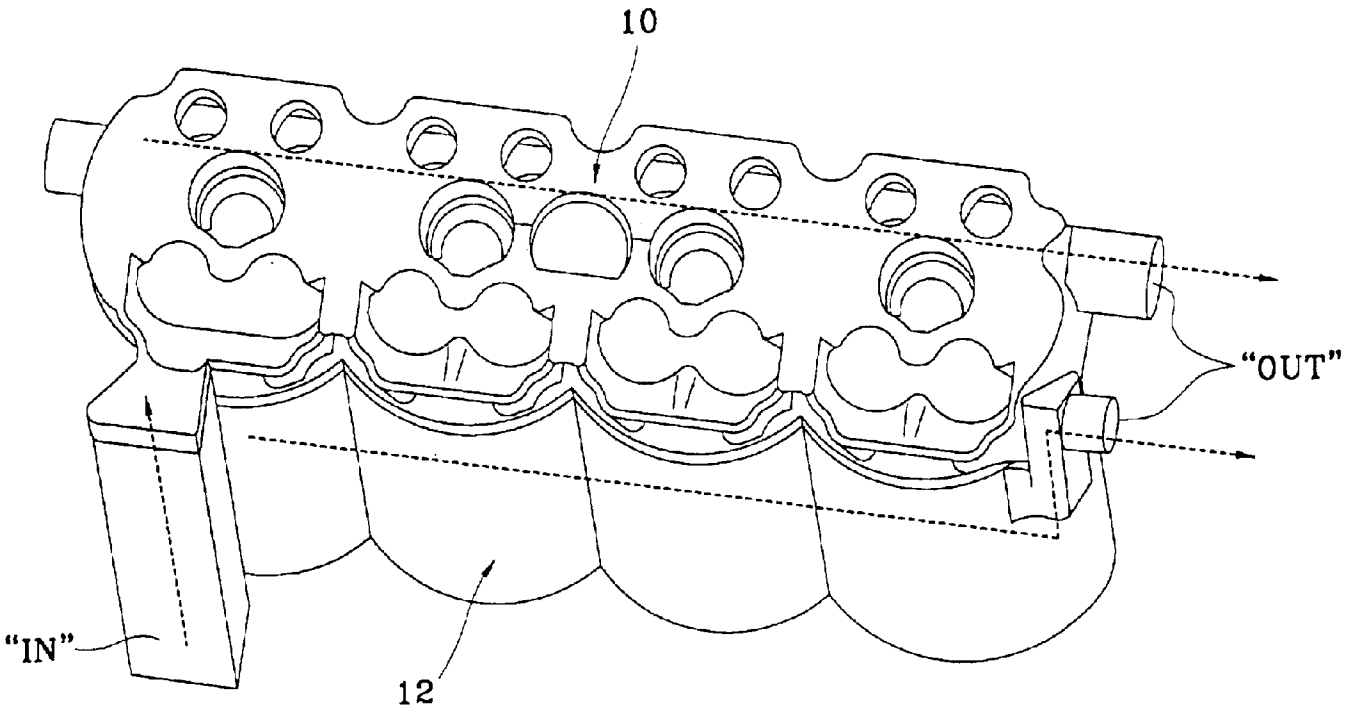
FIG. 1 is a perspective view of a water jacket structure for a cylinder head and cylinder block according to the present invention.

As shown in FIG. 1, according to an embodiment of the present invention, a water jacket 10 of a cylinder head and a water jacket 12 of a cylinder block are provided independently. An inlet IN through which cooling water flows from a pump (not illustrated) to the water jackets 10 and 12 is shared at the front side of the engine by the water jackets 10 and 12 of cylinder head and the cylinder block.

The cross-sectional shape of the inlet IN of the water jackets 10 and 12 is trapezoidal, and its cross sectional area is reduced toward the insides of the cylinder head and the cylinder block. Thus, the flow resistance of the cooling water is diminished when the cooling water flows from the pump to the inlet IN of the jackets 10 and 12, thereby minimizing the pressure loss of the cooling water in the water jackets 10 and 12. As a result, there is a reduction in pressure loss when the cooling water flows through the inlet IN, and the cooling water flows smoothly through the water jackets 10 and 12, thereby achieving an efficient cooling of the cylinder head and the cylinder block.

Further, the outlets OUT of the water jackets 10 and 12 are formed on the rear of the cylinder head and the cylinder block respectively and independently. That is, the outlet OUT of the water jacket 10 of the cylinder head is formed on one side of the cylinder head, while the outlet OUT of the water jacket 12 of the cylinder block is not positioned on the cylinder block but raised toward the cylinder head.

The structure of the water jackets 10 and 12 will be described in more detail below.

Figure 2:
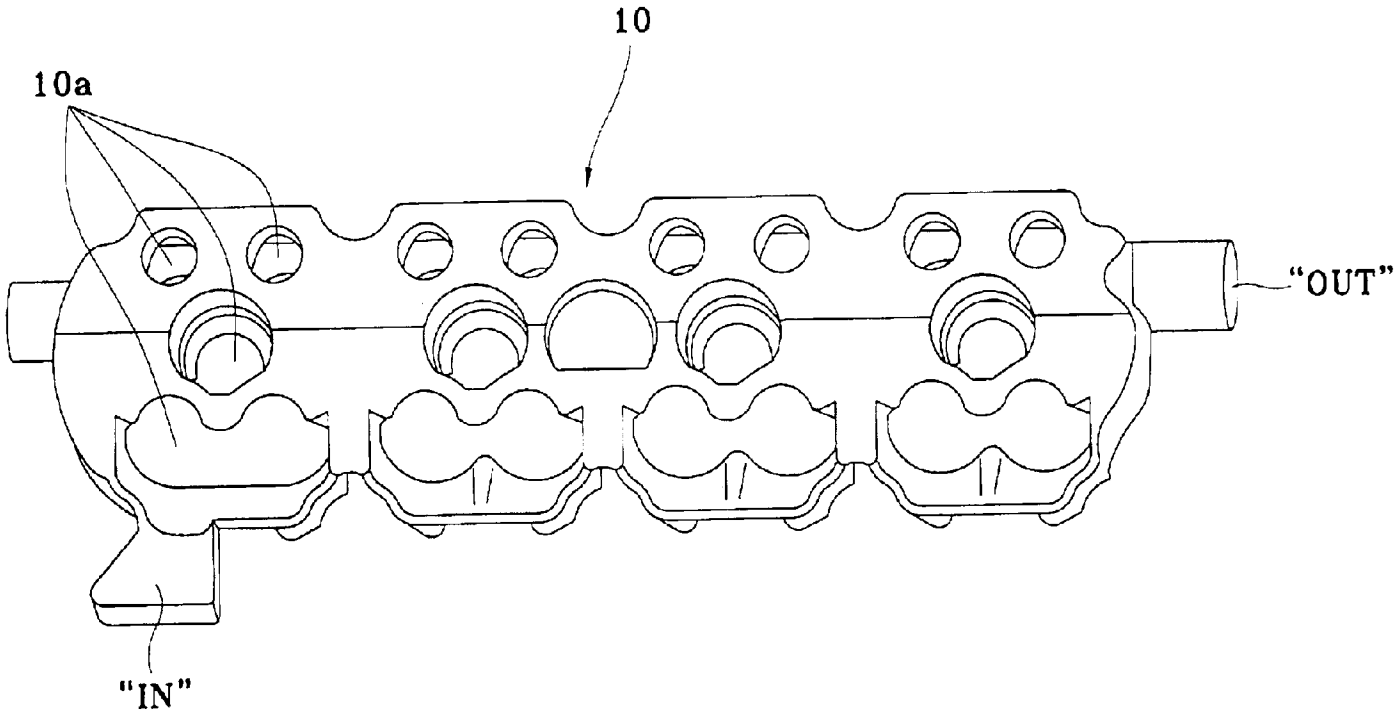
FIG. 2 is a perspective view of a water jacket for the cylinder head.

First, as shown in FIG. 2, the water jacket 10, which is formed within the cylinder head, has an inlet IN formed on the front side of the engine toward the water pump. The inlet cross-sectional shape is trapezoidal, that is, with its cross sectional width being reduced toward the interior of the water jacket 10. Further, there are a plurality of opening parts 10*a* for installing the exhaust ports and the suction ports and the igniting plugs for the respective cylinders. The outlets OUT of the cooling water are formed at the rear end of the engine. The outlets OUT communicate with a thermostat device.

Figure 3:
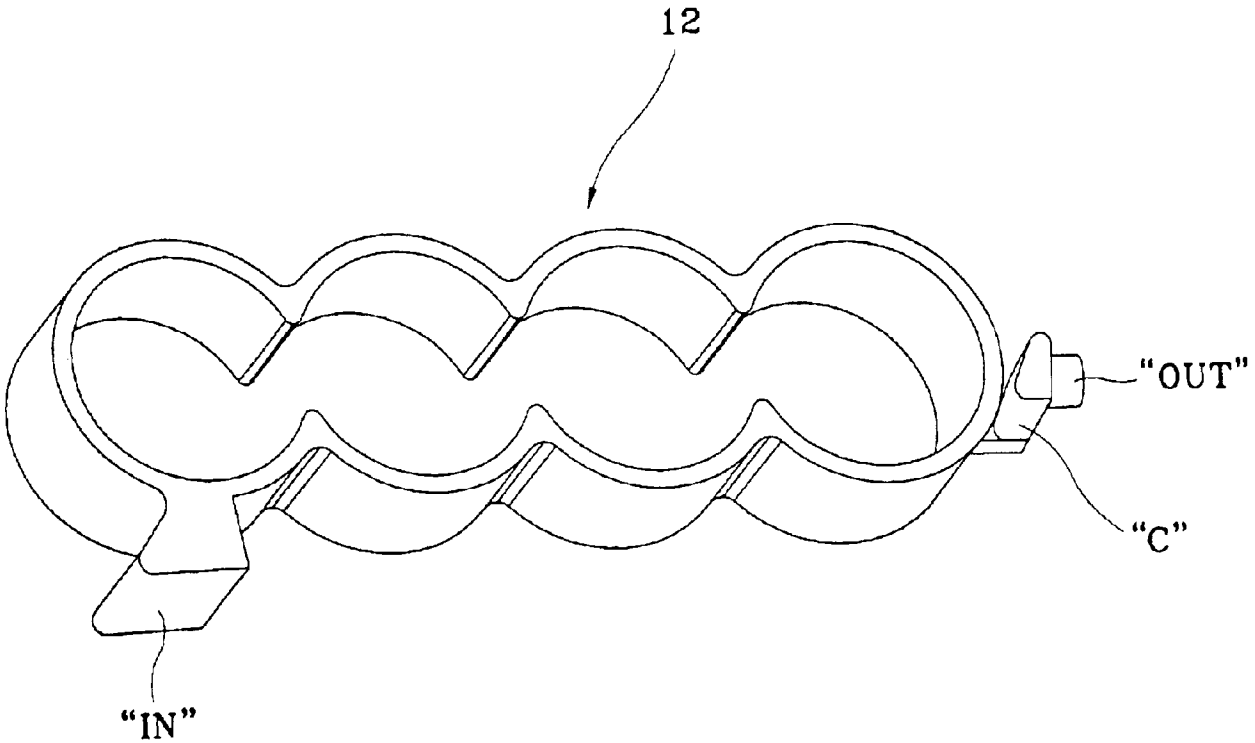
FIG. 3 is a perspective view of a water jacket for the cylinder block.

As shown in FIG. 3, the water jacket 12 of the cylinder block has an inlet IN which is formed at the front side of the engine toward the water pump, and the trapezoidal cross section of the inlet IN is reduced toward the water jacket 12. The water jacket 12 is provided in the form of repeated arcs around the cylinders, while the outlet OUT of the water jacket 12 is raised to the cylinder head through a connection path C.

Figure 4:
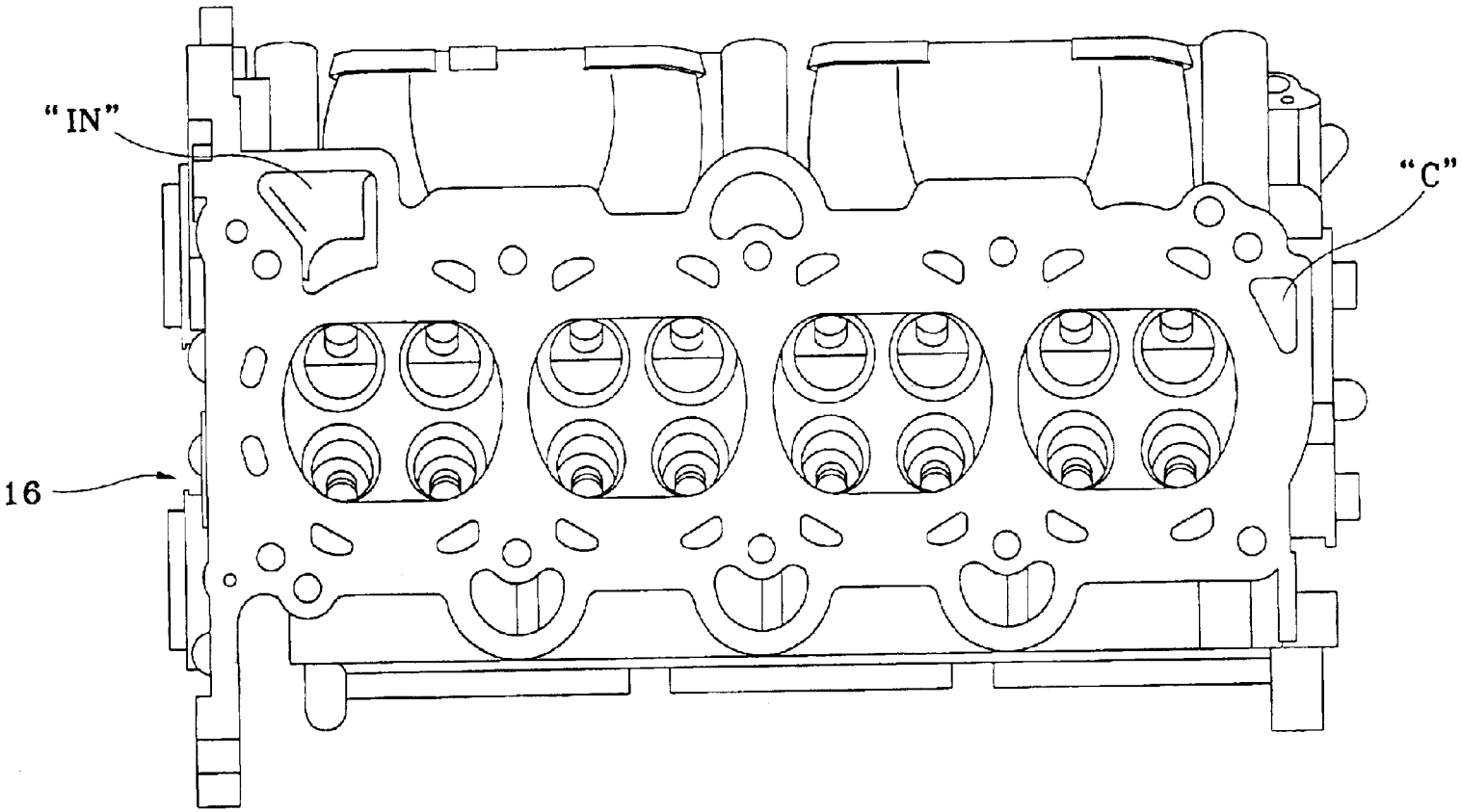
FIG. 4 is a bottom view of the cooling water outlet of a water jacket for the cylinder head.

As shown in FIG. 4, the inlet IN which has a trapezoidal cross section is formed on a bottom side of the cylinder head 16 so as to be shared with the water jacket 12 of the cylinder block 18. Further, the connection path C is formed on the opposite bottom side of the cylinder head 16 so as to communicate with the outlet of the water jacket 12 of the cylinder block 18.

Figure 5:
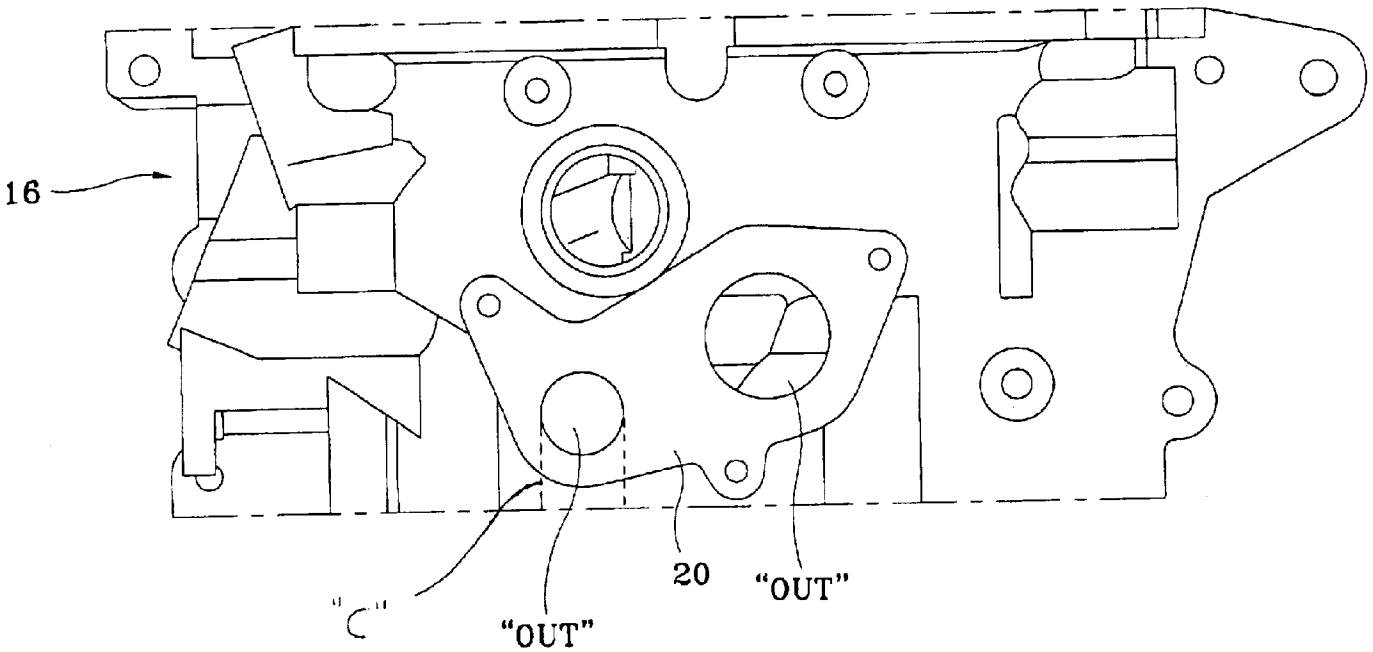
FIG. 5 is a side view of the cooling water outlet of a water jacket for the cylinder head.

As shown in FIG. 5, the outlet OUT of the water jacket 10 of the cylinder head 16 and the outlet OUT of the water jacket 12 of the cylinder block 18 are independently formed on a side of the cylinder head 16. Also formed hereon is a seat surface 20 for installing the thermostat device 14 (FIG. 6) for receiving the cooling water from the two outlets OUT.

Figure 6:
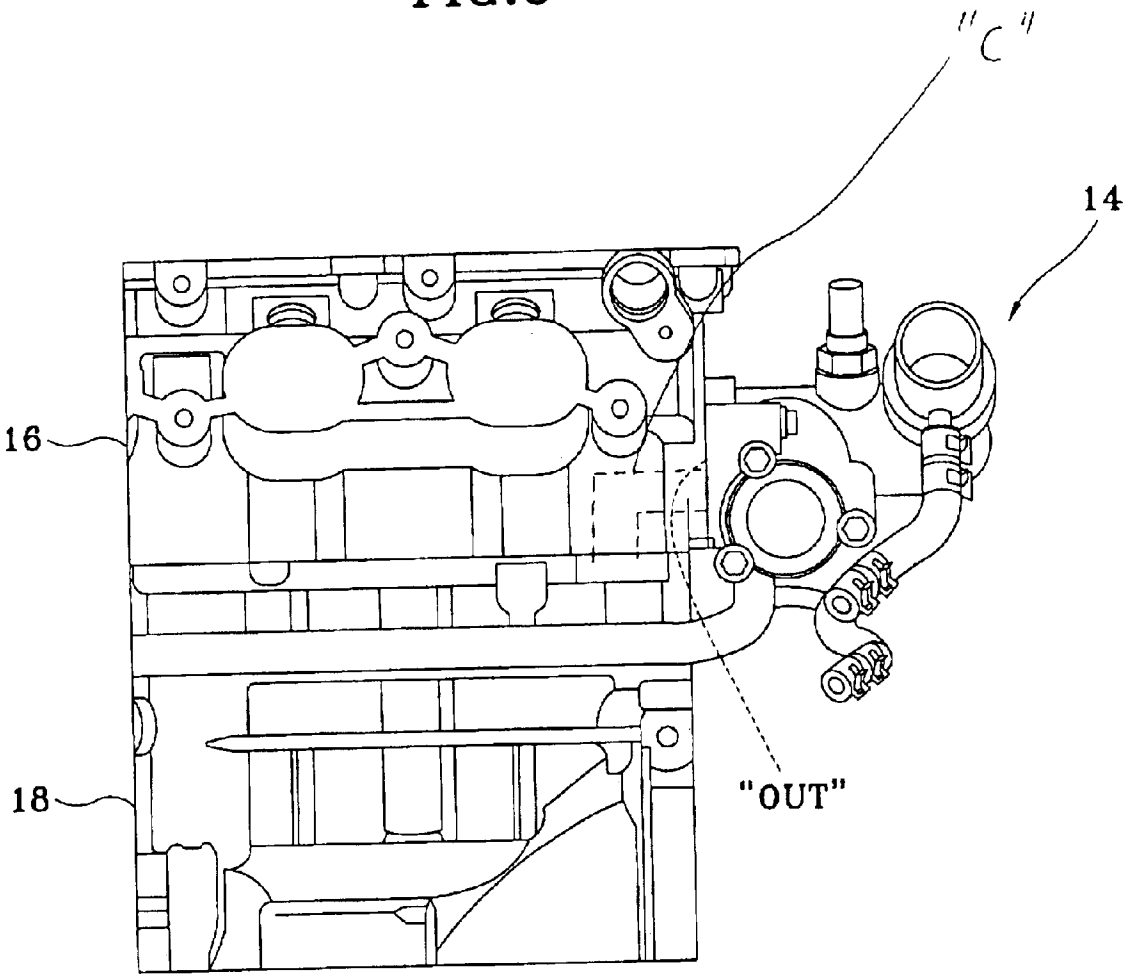
FIG. 6 illustrates an installation of a thermostat device on one side of the cylinder head.

As shown in FIG. 6, the thermostat device 14 is installed on the seat surface 20 which is formed on the side of the cylinder head 16. That is, the thermostat device 14 is mounted limitedly on the side of the cylinder head 16.

Accordingly, in spite of the relative behaviors between the cylinder head 16 and the cylinder block 18, the installation position of the thermostat device 14 is limited to the cylinder head, and therefore, the durability (life expectancy) of the components of the thermostat device is not adversely affected.

According to the present invention as described above, the cross-sectional shape of the inlet (which is shared between the water jacket of the cylinder head and the water jacket of the cylinder block) is trapezoidal, and therefore, an unnecessary vortex is prevented. Thus, the pressure loss which might be caused in the water jackets of the cylinder head and the cylinder block is diminished.

Further, the outlet of the water jacket of the cylinder block is raised to the cylinder head through the connection path, and therefore, the thermostat device can be limitedly installed on the side of the cylinder head. Consequently, in spite of the relative behaviors between the cylinder head and the cylinder block due to the combustion pressures, the life expectancy of the thermostat device can be increased.

What is claimed is:

1. A water jacket structure for a cylinder head and a cylinder block of an engine with a split cooling system adapted therein, the structure comprising:

water jackets formed for said cylinder head and said cylinder block respectively and independently;

an inlet shared between said cylinder head and said cylinder block, with the cross sectional area of said inlet being substantially trapezoidal; and two outlets for said jackets formed on said cylinder head respectively and independently.

2. The water jacket structure as claimed in claim 1, wherein the outlet of the water jacket of said cylinder block is raised to the same or similar level of said outlet for said water jacket of said cylinder head through a connection path.

3. The water jacket structure as claimed in claim 1, wherein a seat surface is formed on one side of said cylinder head for installing a thermostat device, said thermostat device being matched with said two outlets of said water jackets.

4. A cooling structure for a cylinder head and cylinder block of an engine, comprising:

a first water jacket formed on the cylinder head and defining a first inlet of a first width, where said first inlet has a substantially trapezoidal cross-section;

a second water jacket formed around the cylinder block and defining a second inlet of a second width; and a common inlet passage communicating with said first and second inlets, wherein the common inlet passage has a width greater than said first and second widths.

5. The cooling structure of claim 4, wherein said first and second widths are substantially the same.

6. The cooling structure of claim 4, further comprising first and second outlets, respectively communicating with said first and second water jackets, said outlets being separately formed on the cylinder head.

7. The cooling structure of claim 6, wherein said second outlet includes a vertical passage configured and dimensioned such that the first and second outlets open at substantially the same level with respect to the engine.

8. A water jacket structure for a cylinder head and a cylinder block of an engine with a split cooling system adapted therein, the structure comprising:

water jackets formed for said cylinder head and said cylinder block respectively and independently;

an inlet shared between said cylinder head and said cylinder block, with the cross sectional area of said inlet being reduced toward the insides of said water jackets; and two outlets for said jackets formed on said cylinder head respectively and independently.

9. The water jacket structure as claimed in claim 8, wherein the outlet of the water jacket of said cylinder block is raised to the same or similar level of said outlet for said water jacket of said cylinder head through a connection path.

10. The water jacket structure as claimed in claim 8, wherein a seat surface is formed on one side of said cylinder head for installing a thermostat device, said thermostat device being matched with said two outlets of said water jackets.

11. The cooling structure of claim 8, wherein said inlet has a substantially trapezoidal cross-section.

* * * * *